US009061328B2

(12) United States Patent
Detyens, Jr.

(10) Patent No.: US 9,061,328 B2
(45) Date of Patent: Jun. 23, 2015

(54) METHOD FOR CLEANING THE INTERIOR SURFACE OF HOLLOW ARTICLES

(76) Inventor: William R. Detyens, Jr., Mt. Pleasant, SC (US)

( * ) Notice: Subject to any disclaimer, the term of this patent is extended or adjusted under 35 U.S.C. 154(b) by 68 days.

(21) Appl. No.: 13/566,720

(22) Filed: Aug. 3, 2012

(65) Prior Publication Data

US 2014/0037844 A1 Feb. 6, 2014

(51) Int. Cl.

| | |
|---|---|
| ***B08B 9/00*** | (2006.01) |
| ***B05D 7/22*** | (2006.01) |
| ***B08B 9/093*** | (2006.01) |
| ***B08B 9/08*** | (2006.01) |
| ***B08B 9/46*** | (2006.01) |
| ***B24C 3/32*** | (2006.01) |
| *B05D 3/10* | (2006.01) |
| *B05D 3/12* | (2006.01) |
| *B05D 3/00* | (2006.01) |

(52) U.S. Cl.

CPC . *B08B 9/093* (2013.01); *B08B 9/08* (2013.01); *B08B 9/0804* (2013.01); *B08B 9/46* (2013.01); *B08B 2209/08* (2013.01); *B05D 7/22* (2013.01); *B24C 3/325* (2013.01); *B05D 3/102* (2013.01); *B05D 3/12* (2013.01); *B05D 3/002* (2013.01); *B05D 2259/00* (2013.01)

(58) Field of Classification Search

USPC ..... 427/230–239

See application file for complete search history.

(56) References Cited

U.S. PATENT DOCUMENTS

| | | | | |
|---|---|---|---|---|
| 2,108,017 | A | 2/1938 | Lithgow | |
| 3,696,825 | A * | 10/1972 | Guignon et al. | 134/167 R |
| 3,705,437 | A | 12/1972 | Rukavina, Jr. et al. | |
| 3,810,604 | A * | 5/1974 | Reiter | 366/138 |
| 3,895,756 | A * | 7/1975 | Jaeger | 239/227 |
| 4,018,623 | A | 4/1977 | Walker | |
| 4,443,271 | A | 4/1984 | Goerss | |
| 4,538,359 | A | 9/1985 | Steinhaus et al. | |
| 5,056,718 | A * | 10/1991 | Wakefield | 239/441 |
| 5,321,869 | A | 6/1994 | Kaempf | |
| 5,425,183 | A * | 6/1995 | Taylor | 34/73 |
| 5,499,659 | A * | 3/1996 | Naf | 138/97 |
| 5,577,293 | A | 11/1996 | Meredith et al. | |
| 5,711,819 | A * | 1/1998 | Miyasaki | 134/11 |
| 5,849,099 | A | 12/1998 | McGuire | |
| 6,308,720 | B1 | 10/2001 | Modi | |
| 6,457,258 | B1 | 10/2002 | Cressy et al. | |
| 6,532,684 | B1 * | 3/2003 | Tunney et al. | 34/410 |
| 6,595,152 | B2 | 7/2003 | McGuire | |
| 6,726,778 | B2 * | 4/2004 | Wang et al. | 134/8 |
| 6,739,950 | B1 * | 5/2004 | Kruse | 451/37 |
| 6,793,740 | B1 * | 9/2004 | Tunney et al. | 134/21 |
| 7,041,176 | B2 * | 5/2006 | Kruse | 134/8 |
| 7,160,574 | B1 * | 1/2007 | Gillanders et al. | 427/238 |

(Continued)

OTHER PUBLICATIONS

Definition of Against from Oxford English Dictionary, retrieved from http://www.oed.com/view/Entry/3754?redirectedFrom=against &print, Sep. 10, 2103, 25 pages.*

*Primary Examiner* — William Phillip Fletcher, III

(74) *Attorney, Agent, or Firm* — Robert H. Williams

(57) ABSTRACT

A method of blast cleaning the inside of a hollow article, such as a storage tank. The method includes the introduction of outside air and evacuation of inside air to permit blast cleaning to be carried out while managing the conditions within the enclosed interior space within the hollow article. Managing the interior space conditions permits rapid application of protective coatings to the cleaned surface.

7 Claims, 1 Drawing Sheet

(56) References Cited

U.S. PATENT DOCUMENTS

| | | | | |
|---|---|---|---|---|
| 7,348,039 | B2 * | 3/2008 | Aklian et al. | 427/230 |
| 7,517,409 | B1 * | 4/2009 | Gillanders et al. | 118/317 |
| 7,815,742 | B2 | 10/2010 | Falkenstein | |
| 7,858,149 | B2 * | 12/2010 | Gillanders et al. | 427/230 |
| 7,959,741 | B2 | 6/2011 | Green | |
| 8,033,242 | B2 * | 10/2011 | Gillanders et al. | 118/317 |
| 8,206,783 | B2 * | 6/2012 | Gillanders et al. | 427/230 |
| 8,343,579 | B2 * | 1/2013 | Gillanders et al. | 427/238 |
| 2006/0257806 | A1 * | 11/2006 | Crichton | 431/121 |
| 2008/0176487 | A1 * | 7/2008 | Armstrong | 451/39 |
| 2009/0095322 | A1 * | 4/2009 | Wakao et al. | 134/8 |
| 2009/0101178 | A1 | 4/2009 | Wu et al. | |
| 2010/0139019 | A1 * | 6/2010 | Geppert et al. | 15/104.061 |

* cited by examiner

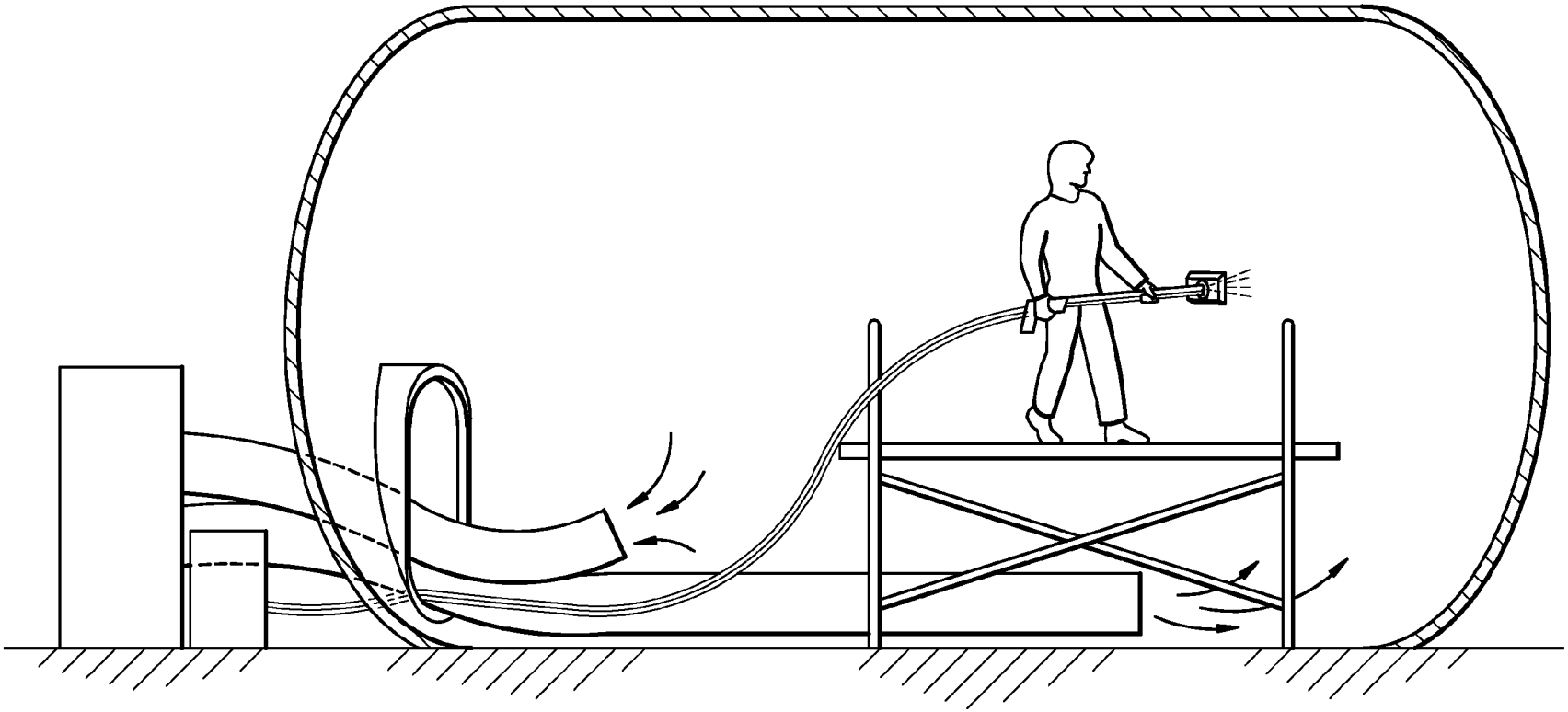

METHOD FOR CLEANING THE INTERIOR SURFACE OF HOLLOW ARTICLES

BACKGROUND OF THE INVENTION

1. Field of the Invention

The present invention relates to cleaning the interior surfaces of hollow articles. The present invention relates more particularly to an improved method of blast cleaning such surfaces, for instance with high-pressure water. The present invention is useful for cleaning objects such as tanks, wherein the interior surfaces are within an enclosed environment. Cleaning operations contemplated within the scope of the disclosed invention include removal of coatings such as paint.

2. Description of Related Art

It is known that blasting, using media such high-pressure water, or an abrasive media such as sand, or other media, can be used to clean many types of surfaces on various objects such as metallic tanks or vessel hulls. This type of cleaning has been applied to removal of coatings such as paint. However, these known methods of cleaning create a need for protection of the worker applying the cleaning method and the substrate which is being cleaned. For example, in abrasive blasting (e.g., sand blasting), there is a need to provide respiratory protection for the worker. As another example, high-pressure water blasting can lead to flash rusting of a metal substrate surface, especially if the substrate has been exposed to saline solutions or other corrosive materials.

The potential for such undesirable effects is even greater when blasting operations are carried out within an enclosed space. For example, high-pressure water blasting is often used to remove coatings from surfaces. However, when high-pressure water blasting is employed within an enclosed space, the temperature and humidity within that space will rise rapidly and create a fog bank. Other blasting methods also create similar undesirable effects when applied within enclosed spaces. Heretofore, the inability to overcome these undesirable effects has prevented the efficient application of high-pressure water blasting to the interior surfaces of enclosed spaces.

BRIEF SUMMARY OF THE INVENTION

It is an object of the present invention to achieve efficient removal of moisture and particulate matter from the enclosed space which is bounded by the interior surface which is being cleaned.

It is a further object of the present invention to control the temperature and humidity within the enclosed space.

Yet another object of the present invention is to enable the rapid removal of an old coating from the interior surface, followed shortly by the application of a protective replacement coating, such as primer or paint, so as to minimize the time when the interior surface is exposed to harmful conditions without a protective coating.

It has been discovered that a given airflow rate within the interior space enclosed by a hollow article can prevent or reduce undesirable effects of a blasting operation carried out therein. By measuring the air moisture and temperature within the enclosed space prior to blasting, and taking into consideration the volume of the enclosed space, along with the number, size, and configuration of the openings into the enclosed space, the necessary rate of airflow to avoid or minimize the undesirable effects of blasting operations can be determined. The predetermined rate of airflow is then achieved by introducing outside air into the interior space while also evacuating inside air from the interior space. The blasting operation may then be carried out while the introduction and evacuation of air is ongoing, ameliorating the difficulties of performing blasting operations within an enclosed space.

In an exemplary embodiment, the disclosed invention is applied to high-pressure water cleaning in the inside of a ship's ballast tank. In this example, the rate of water flow from the high-pressure water blasting is further taken into consideration when determining the required rate of airflow. The pre-determined necessary rate of airflow can be achieved using a dehumidifier to introduce outside air and a vacuum to evacuate inside air. Providing such airflow limits the humidity within the enclosed space so as to prevent flash rusting. Running the dehumidifier and vacuum while the blasting is performed prevents the formation of a fog bank and effectively removes moisture and dust from the interior environment of the hollow article while the high-pressure water cleaning is performed. Accordingly, a protective coating such as paint or primer can be applied very shortly or even immediately after the high-pressure water blasting is completed, without the need for an intermediate drying period or separate steps for debris removal and/or drying.

In a further embodiment, it is also possible to include a pre-treatment step in the disclosed process, such as in the above example where the interior of the ballast tank has been exposed to salt water. Such pre-treatment aids in the prevention of flash rusting which may otherwise occur in the presence of salt water or other corrosive materials.

In yet another embodiment, the disclosed process includes the use of an air scrubber to remove particulate matter from the air which is evacuated from the enclosed interior space. This embodiment is particularly useful, for example, with sand blasting.

The present invention can be used with blasting processes employing any of several media, including water, sand, slurry, dry ice and other media. The discussion herein of high-pressure water blasting or other specific media is provided as an example only and is not intended to be limiting.

BRIEF DESCRIPTION OF THE DRAWING

FIG. 1 illustrates an example embodiment of the inventive process as applied to cleaning the inside of a tank with high-pressure water.

DETAILED DESCRIPTION

In the following description, relative terms such as "inside," and "outside," are with reference to the hollow article which is worked on in the disclosed process, e.g., "inside" refers to the interior of the article, and "outside" refers to the exterior thereof and/or points therebeyond.

In the following description, the inventive process will be illustrated with reference to a particular exemplary embodiment, removing an existing coating of paint from the interior surface of a ballast tank on a marine ship using high-pressure water. The illustrative process which is described further includes applying a replacement coating such as primer to the cleaned surface. It is to be understood that the inventive process can be applied to other hollow articles with enclosed spaces therein and to other blast cleaning processes.

The replacement coatings used with the illustrative process are sensitive to humidity and temperature while applied. Achieving the required airflow with proper ventilation and dehumidifying to optimize the atmosphere inside the tank allows quick and effective application of the replacement coating system. Using a high rate of airflow (typically expressed in cubic feet per minute, or CFM) and using a dehumidifier or air-scrubbing equipment, the high moisture content in the enclosed space which would otherwise be generated by high-pressure water blasting can be reduced to levels sufficient for primers and paints to be applied and adhesion guaranteed. The conditions inside of a tank will be different in every instance. Outside temperature, inside temperature, tank size, and humidity levels will all have an effect on the amount of moisture produced inside of the tank. This will dictate what combination of equipment will be used, but the overall process remains the same.

In the particular context described herein, preliminary steps prior to implementing the inventive process include setting up a system of scaffolding that will allow a seamless flow for the operators of the cleaning and painting equipment. Additionally, airlines, electrical cables and explosion proof lighting are run into the tank. The hoses for the water blasting will be routed as will the vacuum hoses for the removal of water and debris. In some cases, it may be necessary to create an opening in the tank by cutting out a portion of its wall.

The tank's size and shape, along with the size and location of its vents, exits, or other openings will be used to gauge the amount of airflow that will be required and air moisture will be measured before and during the blasting to determine which size of dehumidifier will be required.

Once the required equipment to achieve the determined rate of airflow is in place and operating, the cleaning process can begin. The tank is initially washed down to remove surface debris, then the bottom of the tank is "mucked" out, which can also be performed using pressurized water.

Paint removal will be accomplished by using high-pressure water. In a preferred embodiment, a high-pressure machine which can be used produces approximately 10,000 pounds-per-square-inch ("PSI") of water pressure while using only 3.5 gallons per minute ("GPM") of water. It is to be understood that other pressure ranges can be used as necessary depending on factors such as the condition of the surface to be cleaned. As water blasting is being performed, the wastewater and paint is collected and the water is recycled for continued use. After water blasting is complete, dull scrapers and putty knives are used to scrape the areas of paint still adhered to the metal surface. Once it is determined that no more paint will come off the surface, cleaning is complete.

Testing of the remaining paint and the metal surfaces is the next step. Based on these tests, it is then determined what products will be used to seal the metal to stabilize it until the atmospheric conditions are right for the primer to be applied. The rate of airflow is maintained until the proper atmospheric conditions in the enclosed space for the replacement coating (e.g., primer) have been obtained. Maintaining the airflow in this manner prevents flash rusting of the exposed metal surfaces until the protective replacement coating is applied. Many combinations of sealers, primers and topcoats may be used in this process, based on the particular situation of each individual tank. The coating products used and the application thereof are generally known in the art.

While preferred embodiments and example configurations have been shown and described, it is to be understood that various further modifications and additional configurations will be apparent to those skilled in the art. All such modifications and configurations are contemplated as being within the scope of the present invention. The specific embodiments and configurations disclosed are illustrative of the preferred and best modes for practicing the invention as defined by the appended claims, and should not be interpreted as limitations on the scope of the invention as defined by the appended claims. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A method of cleaning an inside surface of a tank, wherein said tank defines an enclosed interior space therein, said method comprising:

introducing outside air into said interior space of said tank;

evacuating inside air from said interior space; and directing a pressurized jet of a media from within said interior space against said inside surface of said tank in a predominantly outward direction;

wherein the introduction of outside air and the evacuation of inside air are maintained continuously and simultaneously with the direction of said pressurized jet against said inside surface of said hollow article.

2. The method of claim 1, further comprising applying a coating to said interior surface of said tank.

3. The method of claim 1, further comprising pretreating said interior surface of said tank prior to said directing step.

4. The method of claim 1, wherein said media is water.

5. The method of claim 1, wherein said media is sand.

6. The method of claim 1, wherein said media is a slurry.

7. The method of claim 1, wherein said media is dry ice.

* * * * *